US006295429B1

(12) United States Patent
Isobe et al.

(10) Patent No.: US 6,295,429 B1
(45) **Date of Patent: *Sep. 25, 2001**

(54) IMAGE FORMING APPARATUS FEATURING INTERMITTENT OPERATION OF A DEVELOPING UNIT SUPPORTING ROTARY MEMBER BASED ON FIXING TEMPERATURE

(75) Inventors: Hironobu Isobe, Numazu; Kazunori Kobayashi, Susono, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/106,758

(22) Filed: Jun. 30, 1998

(30) Foreign Application Priority Data

Jun. 30, 1997 (JP) ..... 9-190429
Jun. 12, 1998 (JP) ..... 10-181432

(51) Int. Cl.[7] ..... G03G 15/01
(52) U.S. Cl. ..... 399/227
(58) Field of Search ..... 399/119, 226, 399/227

(56) References Cited

U.S. PATENT DOCUMENTS 4,697,915 * 10/1987 Hayashi et al. ..... 399/227
4,916,490 * 4/1990 Tanaka et al. ..... 399/119
5,565,973 * 10/1996 Fujishiro et al. ..... 399/227
5,797,069 * 8/1998 Kimura et al. ..... 399/227 X
5,799,228 * 8/1998 Iwata et al. ..... 399/227
5,809,370 9/1998 Ueno ..... 399/81

FOREIGN PATENT DOCUMENTS 196 54 281 10/1997 (DE) .
0 678 794 A2 4/1995 (EP) .
62-103659 5/1987 (JP) .
6-43756 2/1994 (JP) .
6-258905 * 9/1994 (JP) .
8-006399 * 1/1996 (JP) .
9-80856 3/1997 (JP) .

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes an image bearing member are a plurality of developing units for developing electrostatic latent images formed on the image bearing member with different color images. A rotatable developing rotary supports the plurality of developing units, which are detachably movable to the rotary member. A heat fixing device fixes the toner on a recording material after the toner image is transferred onto the recording material from the image bearing member. A controller executes, an intermittent rotating operation, before the image forming apparatus is brought into a stand-by state, when a fixing temperature of the fixing device is lower than a predetermined level.

14 Claims, 15 Drawing Sheets

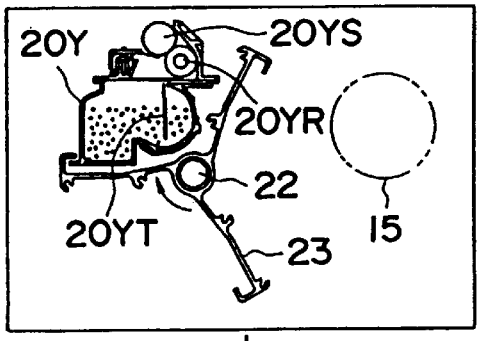
FIG. 16(A)
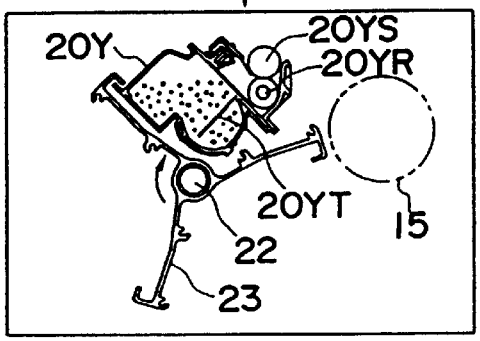
FIG. 16(B)
FIG. 16(C)
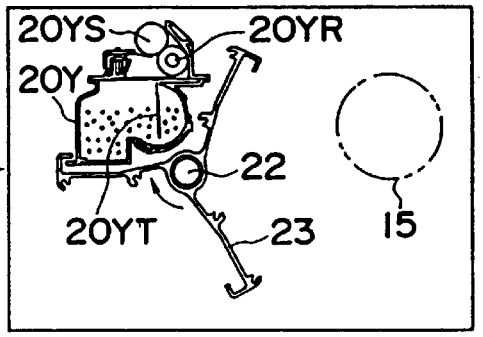
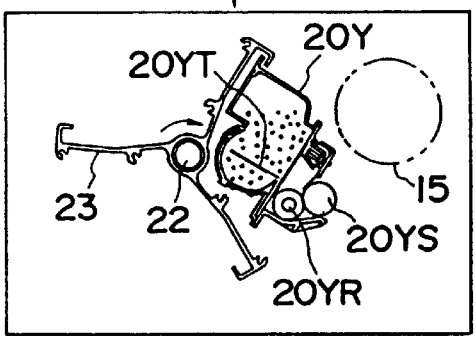
FIG. 16(D)
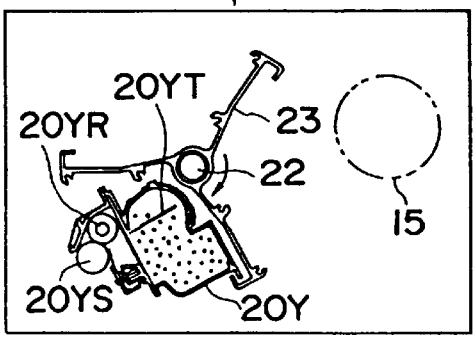
FIG. 16(E)
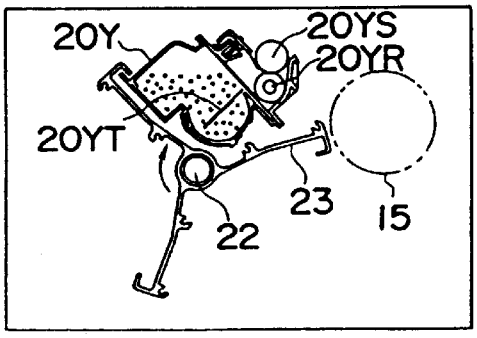
FIG. 16(F)

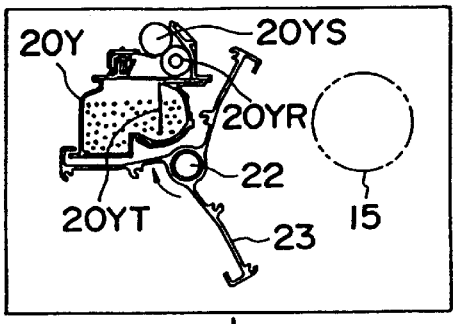
FIG. 17(A)
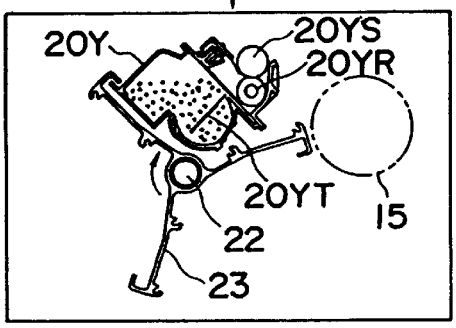
FIG. 17(B)
FIG. 17(C)
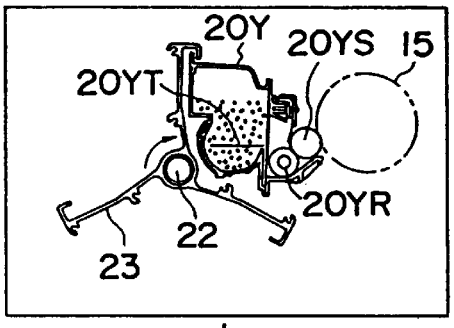
FIG. 17(D)
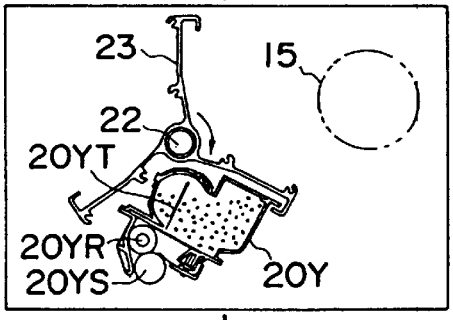
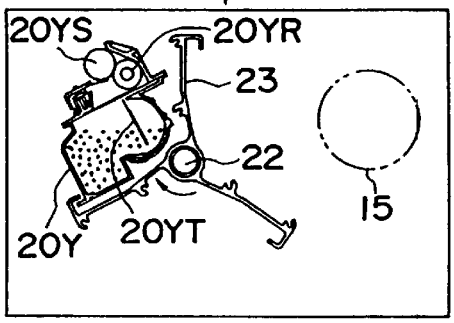
FIG. 17(E)
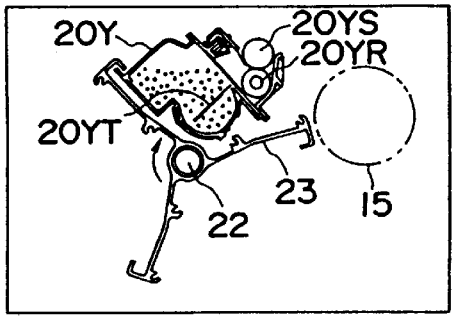
FIG. 17(F)

IMAGE FORMING APPARATUS FEATURING INTERMITTENT OPERATION OF A DEVELOPING UNIT SUPPORTING ROTARY MEMBER BASED ON FIXING TEMPERATURE

FIELD OF THE INVENTION AND RELATED ART

The present invention relates to an electrophotographic image forming apparatus.

In this specification, an electrophotographic image forming apparatus means an apparatus that forms an image on recording medium with the use of an electrophotographic image forming system. It includes, for example, an electrophotographic copying machine, an electrophotographic printer (laser beam printer, LED printer, and the like), a facsimile machine, a word processor, and the like.

A typical structure of a color laser beam printer prior to the present invention is as follows. A charging roller, to which voltage is being applied, is placed in contact with a photosensitive drum, with a predetermined contact pressure, to uniformly charge the peripheral surface of a photosensitive drum so that a latent image can be formed.

The charged peripheral surface of the photosensitive drum is exposed by a scanning section which comprises a laser diode. More specifically, the laser diode emits a laser beam modulated with image data signals toward a polygon mirror, which deflects the laser beam. The deflected laser beam is projected upon a polygon mirror, whereby the laser beam is caused to make a scanning movement in the direction of the generation of the photosensitive drum 1 while being focused upon the peripheral surface of the photosensitive drum 1 through an image forming lens and a deflection mirror; the scanning laser beam is projected upon the peripheral surface of the photosensitive drum 1.

As a result, a plurality of electrostatic latent images correspondent to different primary color components of an original image, are formed on the peripheral surface of the photosensitive drum 1 by the laser beam modulated with the image data signals.

An image development rotary comprises a development unit for developing the latent image correspondent to magenta color, a development unit for developing the latent image correspondent to cyan color, a development unit for developing the latent image correspondent to yellow color, and a development unit for developing the latent image correspondent to black color.

In a latent image developing operation, the latent image developing unit (hereinafter, development unit), which contains the color toner correspondent to the latent image to be developed, is stopped at a position (hereinafter, developing position) where the distance between the peripheral surface of the latent image developing roller (hereinafter, development roller) of the development unit, and the peripheral surface of the photosensitive drum 1, becomes minimum, that is, microscopic.

As the development unit is moved to the developing position, the development roller is connected to a high voltage power source of the main assembly of the image forming apparatus, so that bias for developing a latent image (hereinafter, development bias) is applied to the development unit. At the same time, the development roller is engaged with a driving means linked with the driving power source on the main assembly side of the image forming apparatus.

As the development roller is rotatively driven while the development bias is applied to the development roller, the latent image on the photosensitive drum is developed into a toner image.

The development unit is in the form of a development cartridge which integrally comprises the development roller as a latent image developing member, and a toner storing portion. The development unit in the form of a cartridge makes it possible for a user to maintain the image forming apparatus without relying on service personnel, and therefore, the operability of the apparatus is greatly improved. Thus, the development unit in the form of a cartridge (hereinafter, development cartridge) is widely used as a development unit for the electrophotographic image forming apparatus.

SUMMARY OF THE INVENTION

The present invention is an invention made by further developing the conventional technologies.

The primary object of the present invention is to provide an electrophotographic image forming apparatus which can form a desirable image on recording medium.

Another object of the present invention is to provide an electrophotographic image forming apparatus which can loosen the powder toner used for developing an electrostatic latent image, before developing the latent image.

Another object of the present invention is to provide an electrophotographic image forming apparatus, the development unit driving motor of which does not need to generate as much torque as the torque which the apparatus prior to the present invention must generate, to rotatively drive the development unit.

Another object of the present invention is to provide an electrophotographic image forming apparatus in which an intermittent development rotary rotation sequence, in which an image developing rotary is rotated, and then, temporarily stopped, is repeated a plurality of times immediately after one or more image development units are replaced.

Another object of the present invention is to provide an electrophotographic image forming apparatus in which development units are fitted in an image development rotary, and which requires less initial torque for driving the development unit than the apparatus prior to the present invention.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 16(A) through 16(F) are sequential drawings which depict a rotational sequence of a development rotary in the first embodiment of the present invention.

FIGS. 17(A) through 17(F) are sequential drawings which depict a rotational sequence of the development rotary in the first embodiment.

DESCRIPTION OF THE PREFERRED EMBODIMENTS

Figure 1:
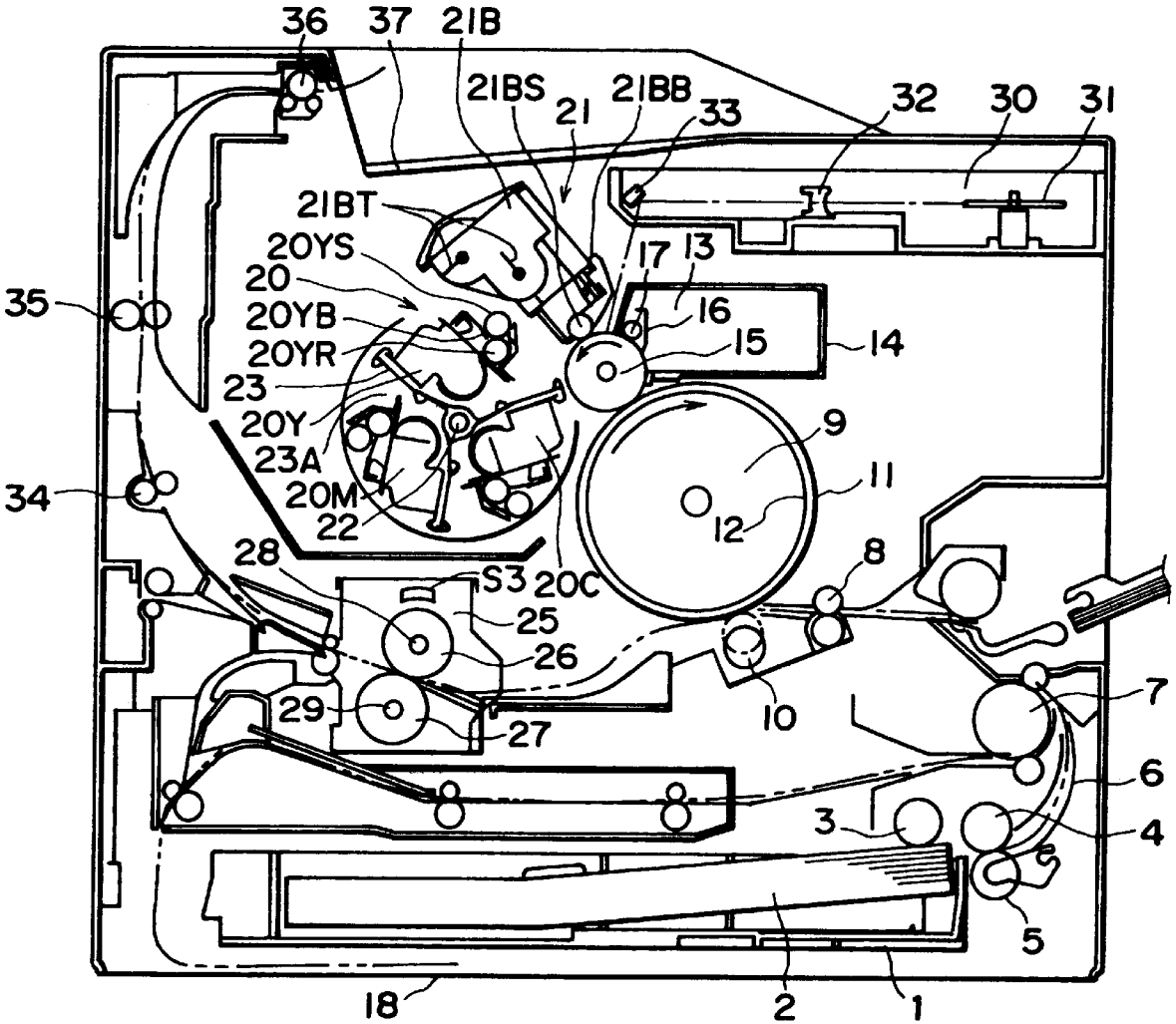
FIG. 1 is a vertical section of the color laser beam printer in accordance with the present invention.
Figure 2:
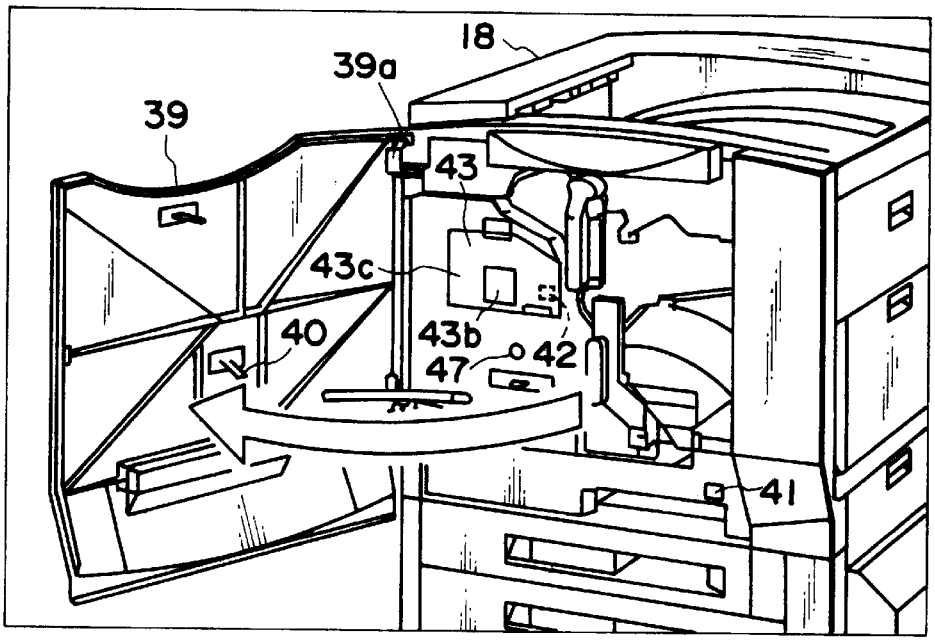
FIG. 2 is a perspective drawing which depicts a method for installing a development unit into the main assembly of the printer.

Hereinafter, a color image forming apparatus in accordance with the present invention will be described with reference to the drawings.

Embodiment 1

(General Structure of Image Forming Apparatus)

First, the general structure of an electrophotographic color image forming apparatus will be described with reference to FIG. 1, which is a vertical section of a color laser beam printer, that is, a typical form of a color image forming apparatus.

The image forming section of the color laser beam printer comprises an image bearing member 15 (for example, an electrophotographic photosensitive drum) which rotates at a predetermined constant seed, a black color development unit 21B which is fixedly disposed, and three color development units: a yellow color development unit 20Y, a magenta color development unit 20M, and a cyan color development unit 20C, which are rotative.

Below the image forming section, an image transferring intermediary member 9 (hereinafter, intermediary transfer member) is disposed, which temporarily holds color toner images of different color transferred onto the intermediary transfer member in a superimposing manner, and then transfers them onto a recording medium 2 delivered from an recording medium feeding section. After the color toner images are transferred onto the recording medium 2, the recording medium 2 is conveyed to a fixing device 25, in which the color toner images are fixed to the recording medium 2. Thereafter, the recording medium 2 is discharged by discharge rollers 34, 35 and 36, into a delivery section 37 which is located on the top side of the printer. The recording medium 2 is constituted of a sheet of ordinary paper, an OHP sheet, or the like.

The rotative color development units and the stationary black color development unit are rendered individually installable into, or removable from, the main assembly 18 of the printer.

Next, the structures of the various sections of the image forming apparatus will be described in detail in a logical order.

(Image Bearing Member Unit)

A drum unit 13 integrally comprises an image bearing member 15 (hereinafter, photosensitive drum), a cleaning apparatus, a charging apparatus, and a cleaning apparatus holder 14 which doubles as the holder for the photosensitive drum 15. The drum unit 13 is removably installable in the printer main assembly 18, so that the drum unit 13 can be easily replaced as the service life of the photosensitive drum 15 expires.

The photosensitive drum 15 in this embodiment is constituted of an aluminum cylinder with a diameter of 62 mm, and a layer of organic photoconductive material coated on the peripheral surface of the aluminum cylinder. It is rotatively supported by the cleaning apparatus container 14 that doubles as the photosensitive drum holder.

Along the peripheral surface of the photosensitive drum 15, a cleaning blade 16, and a primary charging means 17 as a charging member, are disposed. The photosensitive drum 15 is rotated in the counterclockwise direction in synchronism with the image forming operation, by the driving force transmitted from an unillustrated motor to the one of the longitudinal ends of the photosensitive drum 15, that is, the end at the rear in FIG. 1. The cleaning blade 16 is placed in contact with the peripheral surface of the photosensitive drum 15, to remove the toner particles remaining on the peripheral surface of the photosensitive drum 15 after toner image transfer.

(Charging Means)

The charging means 17 employs a contact type charging method. It comprises an electrically conductive charging roller as a charging member, which is placed in contact with the photosensitive drum 15. The peripheral surface of the photosensitive drum 15 is uniformly charged by applying voltage to this electrically conductive roller.

(Exposing Means)

The photosensitive drum 15 is exposed by the scanning section 30. More specifically, image signals are provided to a laser diode, the laser diode projects a laser beam modulated with the image signals onto a polygon mirror 31. The polygon mirror 31 is being rotated at a high speed by a scanner motor, and therefore, the laser beam modulated with the image signals is moved in a scanning movement. The laser beam, which is making a scanning movement, is sent through the image forming lens 32, and is deflected by the deflecting mirror 33 toward the peripheral surface of the photosensitive drum 15, which is rotating at the predetermined constant velocity. As a result, the peripheral surface of the photosensitive drum 15 is exposed in a manner to reflect the image signals, and consequently, an electrostatic latent image reflecting the image data is formed on the peripheral surface of the photosensitive drum 15.

(Latent Image Developing Mechanism)

The latent image developing system (hereinafter, development system) in this embodiment comprises: three rotative latent image development units, which are a yellow image developing unit 20Y, a magenta image developing unit 20M, and a cyan image developing unit 20C, and which develop yellow, magenta, and cyan color images, correspondingly; and one stationary development unit 21B which develops a black color image. In a color image forming operation, the development rotary 23 is rotated once for each rotation of the intermediary transfer member 9, to position the yellow image developing unit 20Y, the magenta image developing unit 20M, the cyan image developing unit 20C, and the black image developing unit 21B, in that order, at the image developing position, where the latent images are developed into the correspondent color images.

(Black Image Developing Unit)

The black image developing unit 21B is a stationary unit, or a nonrotative unit, and is removably installed in the printer main assembly 18 in such a manner that the peripheral surface of the development roller 21BS of the black image developing unit 21B is positioned a microscopic distance (approximately 300 $\mu$m) away from the peripheral surface of the photosensitive drum 15. The black image developing unit 21B develops a latent image correspondent to the black component of the original image into a black toner image. It comprises a black toner storing portion and the development roller 21BS.

As depicted by FIG. 1, in the black image developing unit 21B, the toner is delivered to the development roller 21BS by a toner delivering member 21BT disposed in the black toner storing portion. The toner having been delivered to the vicinity of the development roller 21BS is coated in a layer on the peripheral surface of the development roller 21BS which is being rotated in the clockwise direction by a development blade 21BB placed in contact with the peripheral surface of the development roller 21BS with a predetermined pressure. While the toner is coated on the development roller 21BS, the toner is triboelectrically charged.

Then, as bias for developing a latent image (hereinafter, development bias) is applied to the development roller 21BS, the toner particles in the toner layer jump from the development roller 21BS to the peripheral surface of the peripheral surface of the photosensitive drum 15 in a manner to reflect the electrostatic latent image (jumping development); the latent image on the peripheral surface of the photosensitive drum 15 is reversely developed into a toner image.

In consideration of toner consumption, the toner containing portion of the black image developing unit 21B is given a toner capacity equivalent to 15,000 images (in terms of A4 size, being covered four percent with toner, in JIS standard), which is approximately twice or more the toner capacity of the other development units 20Y, 20M or 20C.

Giving the black image developing unit 21B such a large toner capacity as described above can reduce the frequency with which the black image developing unit 21B must be replaced by the user, as well as the cost per print.

The point at which the black image developing unit 21B is disposed is between the laser scanner section 30 as an exposing apparatus, and the development rotary 23 comprising the development units 20Y, 20M and 20C. Placing the black image developing unit 21B in this manner prevents the toner from being scattered as far as optical components such as the laser scanner section, even if the toner should leak as the unit 20Y, 20M or 20C is rotated; in other words, even if the toner leaks, the leaked toner is prevented from adhering to the polygon mirror 31, the image forming lens 32, the deflecting mirror 33, and the like, and therefore, interfering with the formation of a latent image. As a result, a clear image can be outputted.

(Color Developing Unit)

Each of the three development units 20Y, 20M and 20C stores toner by the amount equivalent to approximately 7000 images (in terms of A4 size sheet, covered four percent with toner, in JIS standard), and is removably held by the development rotary 23, which is rotatably about an axis 22.

In an image forming operation, the development units 20Y, 20M and 20C, which are supported by the development rotary 23, are rotatively moved about the axis 22, as the development rotary 23 is rotated. Then, as the development unit, which is to be immediately used for latent image development, comes to the point at which the distance between the peripheral surface of the development unit from the peripheral surface of the photosensitive drum 15 is smallest, the rotation of the development rotary is stopped. The longitudinal end portions of the development roller 20YS of the development unit, for example, the yellow image developing unit 20Y which stores the yellow toner, is fitted with a spacer ring 20YK (FIG. 14), which is coaxial with the development roller 20YS. The external diameter of the spacer ring 20YK is slightly larger than that of the development roller 20YS. As the spacer roller 20YK remains in contact with the peripheral surface of the photosensitive drum 15, a microscopic gap (approximately 300 $\mu$m) is secured between the development roller 20YS and the photosensitive drum 15, to develop an electrostatic latent image on the photosensitive drum 15 into a toner image. This arrangement for maintaining a microscopic gap between the photosensitive drum 15 and the development roller 20YS also applies to the development units for other colors.

Figure 12:
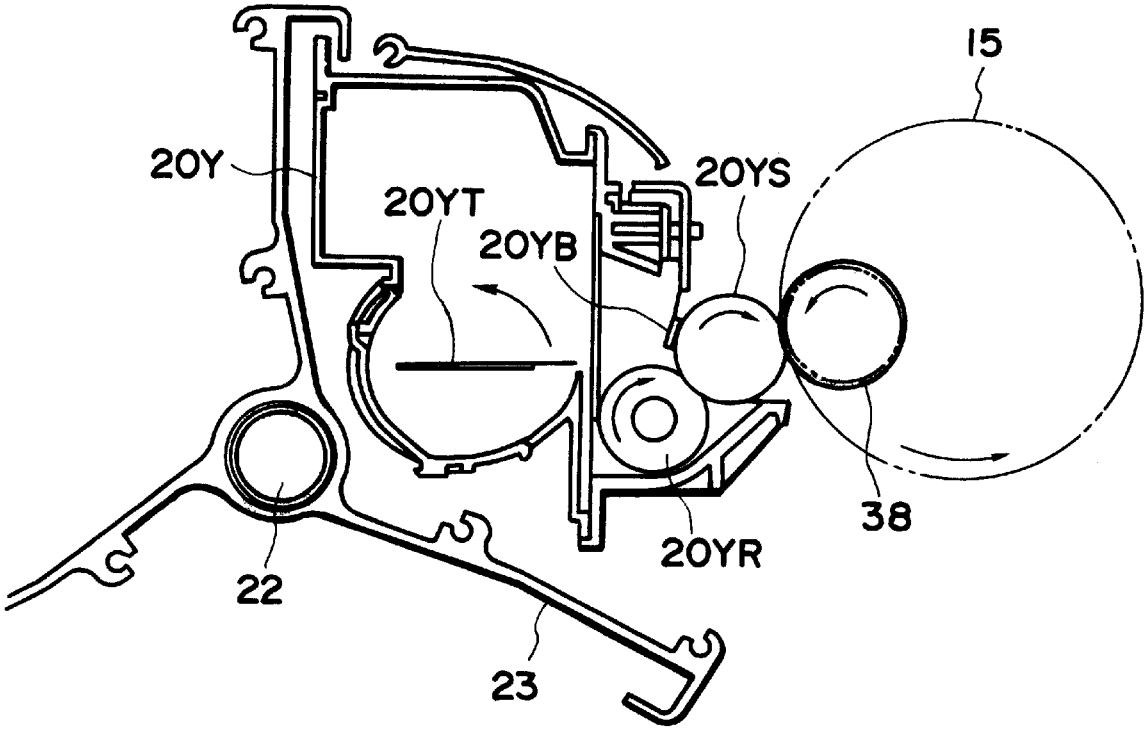
FIG. 12 is a section of a development unit at the image developing position.

Referring to FIG. 12, which depicts the yellow image developing unit 20Y which is standing still after being moved to the position where the distance between the peripheral surfaces of the photosensitive drum 15 and development roller 20YS is smallest, the development unit 20Y will be described. In the development unit 20Y, yellow toner is delivered to a toner coating roller 20YR by the toner delivering member 20YT disposed within the container. After being delivered to the vicinity of the coating roller 20YR, which is being rotated in the clockwise direction indicated by an arrow mark in the drawing, the toner is coated on the peripheral surface of the development roller 20YS, by the coating roller 20YR, and a blade 20YB placed in contact with the peripheral surface of the development roller 20YS with a predetermined pressure, while being triboelectrically charged by the coating roller 20YR and the blade 20YB.

Then, as development bias is applied to the development roller 20YS placed adjacent to the photosensitive drum 15 on which a latent image has been formed, a toner image which reflects the latent image is formed on the photosensitive drum 15. This latent image developing system for the yellow image developing unit 20Y also applies to the magenta image developing unit 20M and the cyan image developing unit 20C. The yellow image developing unit 20Y comprises the development roller 20YS, and a storing portion for storing yellow toner. Similarly, the magenta color image developing unit 20M comprises a development roller 20MS and a storing portion for storing magenta oner, and the cyan color image developing unit 20C comprises a development roller 20CS and a storing portion for storing cyan toner.

As the development roller of the development unit arrives at the latent image developing point as the development rotary is rotated, the development roller is connected to a high voltage power source and a driving gear 38, which are provided in the printer main assembly 18, so that a voltage which is specific to each development roller is applied to the development roller, and the development roller is rotatively driven.

(Image Transferring Intermediary Member)

For the formation of a single color image, the image transferring intermediary member 9 (hereinafter, intermediary transfer member) receives toner images four times; four toner images (yellow, magenta, cyan and black toner images), each of which is formed by a development unit dedicated to a specific color, and therefore, is different in color from the other, are transferred, in a superposing manner, onto the intermediary transfer member 9. In an image transferring operation, the intermediary transfer member 9 is rotated in the clockwise direction indicated in the drawing, in synchronism with the peripheral velocity of the photosensitive drum 15. After the color toner images are transferred onto the intermediary transfer member 9 in a superposing manner, a recording medium 2 is delivered to the interface between the intermediary transfer roller 9, and the transfer roller 10 to which voltage is being applied, and then, as the recording medium 2 is conveyed through the interface, being pinched by the intermediary transfer roller 9 and the transfer roller 10, the color toner images of different color on the intermediary transfer roller 9 are transferred all at once onto the recording medium 2 in a superposing manner.

The intermediary transfer roller 9 in this embodiment comprises an aluminum cylinder 12 with a diameter of 186 mm, and an elastic layer 11 which covers the peripheral surface of the aluminum cylinder 12. The material for the elastic layer 11 is sponge, rubber, or the like, with electrical resistance in a medium range. The intermediary transfer member 9 is rotatively supported, and is rotatively driven through a gear integrally formed with the intermediary transfer member 9 (unillustrated).

(Cleaning Means)

The cleaning means cleans the toner (waste toner) which is remaining on the peripheral surface of the photosensitive drum 15 after the toner images, that is, the visual images formed on the peripheral surface of the photosensitive drum 15 by the developing means, are transferred onto the intermediary transfer member 9. The toner having been removed from the photosensitive drum 15 is stored in the waste toner bin 14 of the cleaning means. The waste toner bin 14 is given a capacity larger than the total amount of the waste toner which is estimated to be produced throughout the service life (equivalent to approximately 50,000 images) of the photosensitive drum 15; since the waste toner bin 14 is integral with the cleaning means holder which also holds the photosensitive drum 15, the old waste toner bin 14 is automatically replaced with a fresh one as the photosensitive drum 15 is replaced with a fresh one after reaching the end of its service life. In this embodiment, a cleaning blade 16 is used as the cleaning member.

(Recording Medium Feeding Section)

The recording medium feeding section is a section for delivering the recording medium 2 to the image forming section. It primarily comprises: a feeder cassette 1 which stores a plurality of recording medium; a feeder roller 3; a feeder roller 4; a retarding roller 5 for preventing recording medium from being fed by two or more; a recording medium guide 6; and a registration roller 8.

In an image forming operation, the feeder roller 3 is rotatively driven in synchronism with the image forming operation, so that the recording medium 2 in the feeder cassette 1 are fed out of the feeder cassette into the printer main assembly, one by one, while being separated by the feeder roller 3. Then, the recording medium 2 is guided to the conveyer roller 7 by the recording medium guide 6, and then is further conveyed by the conveyer roller 7 to the registration roller 8.

The registration roller 8 is intermittently rotated with predetermined timing so that the recording medium 2 and the toner images align with each other in the following image forming step, that is, the image transferring process; in other words, the registration roller 8 is temporarily stopped to temporarily stop the forwarding of the recording medium 2, and then, is rotated again to convey the recording medium 2 toward the intermediary transfer roller 9.

(Image Transferring Section)

The image transferring section comprises a transfer roller 10, as an image transferring member. The transfer roller 10 is constituted of a metallic shaft, and a layer of foamed elastic material with electrical resistance in a medium range which is wrapped around the peripheral surface of the metallic shaft. It is rotatively driven, and also can be pivoted between a top position and a bottom position about the axis of the member which supports the transfer roller 10.

While the four color toner images are being transferred onto the intermediary transfer member 9, that is, while the intermediary transfer member 9 is being rotated a plurality of times to receive the four toner images, the transfer roller 10 is kept at the bottom position outlined with a solid line in the drawing, being separated from the intermediary transfer member 9, so that the toner images are not disturbed.

After all four toner images are transferred onto the intermediary transfer member 9, the transfer roller 10 is moved by an unillustrated member such as a cam to the top position indicated with a fine dot-chain line in the drawing, in synchronism with the timing with which the color toner images are transferred onto the recording medium 2; in other words, the transfer roller 10 is pressed upon the intermediary transfer member 9, with the recording medium 2 being pinched between the transfer roller 10 and the intermediary transfer member 9. At the same time as the transfer roller 10 is moved to the top position, bias begins to be applied to the transfer roller 10, and therefore, the toner images on the intermediary transfer member 9 are transferred onto the recording medium 2.

Since both the intermediary transfer member 9 and the transfer roller 10 are driven, the recording medium 2 pinched between the two members is conveyed at a predetermined speed leftward in the drawing, that is, toward a thermal fixing device 25 in which the next image forming process is carried out.

(Image Fixing Device)

The toner images formed on the photosensitive drum 15 by the developing means 20 and 21 are transferred onto the recording medium 2 by way of the intermediary transfer member 9. The thermal fixing device 25 fixes, with the use of heat, the toner images having been transferred onto the recording medium 2. As depicted in FIG. 1, the thermal fixing device 25 comprises a fixing roller 26 for applying heat to the recording medium 2, and a pressure roller 27 for pressing the recording medium 2 upon the fixing roller 26. Both rollers are hollow, and contain heaters 28 and 29, respectively. They convey the recording medium 2 by being rotatively driven.

Thus, while the recording medium 2 which is holding the toner images is conveyed by the fixing roller 26 and the pressure roller 27, heat and pressure are applied to the toner images and the recording medium 2, whereby the toner images are fixed to the recording medium 2.

(Installation of Color Development Unit)

Figure 3:
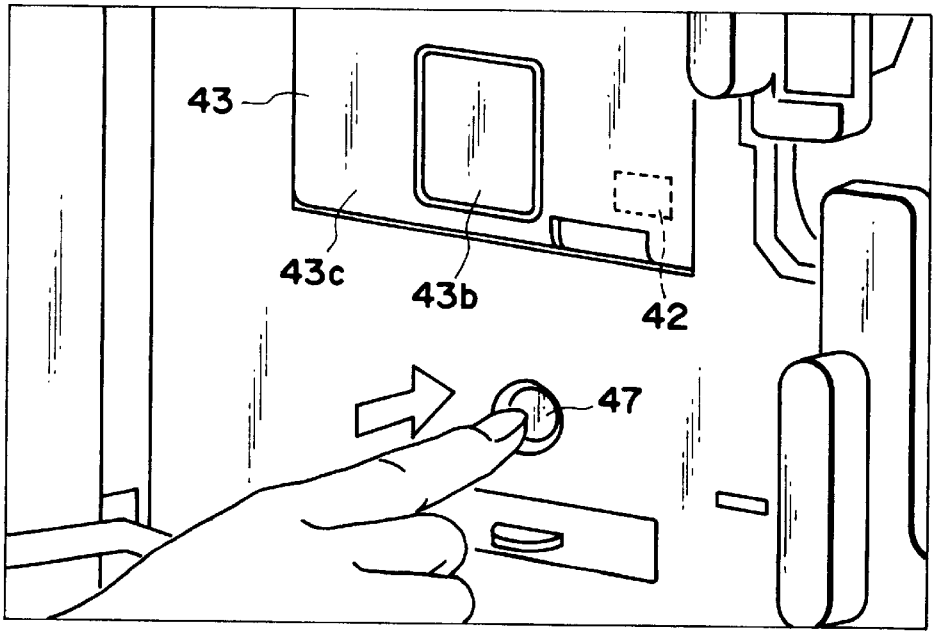
FIG. 3 is a perspective drawing which depicts the method for installing a development unit into the main assembly.
Figure 4:
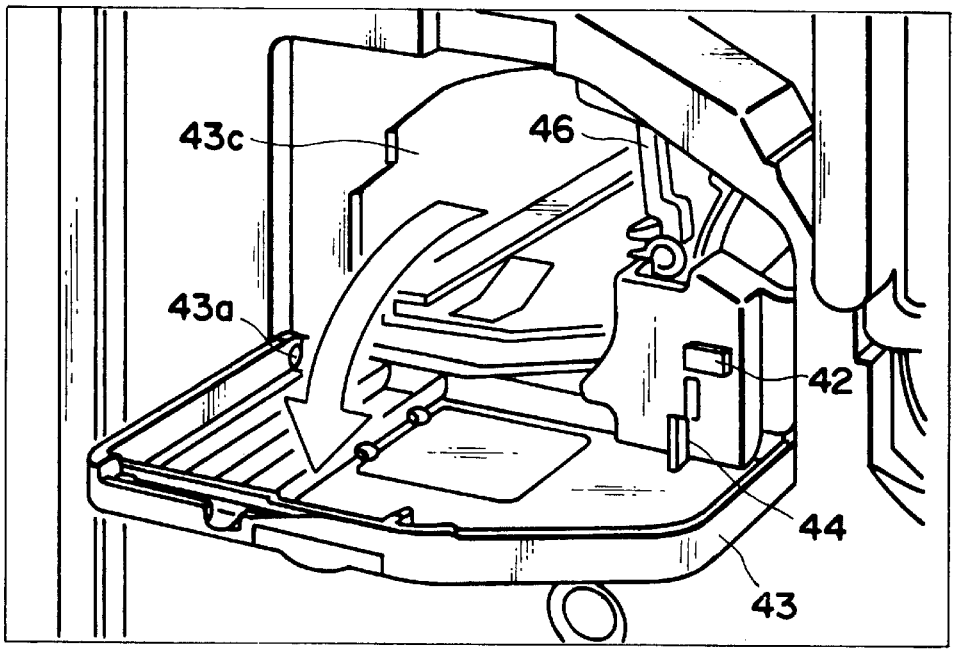
FIG. 4 is a perspective drawing which depicts the method for installing a development unit into the main assembly.
Figure 5:
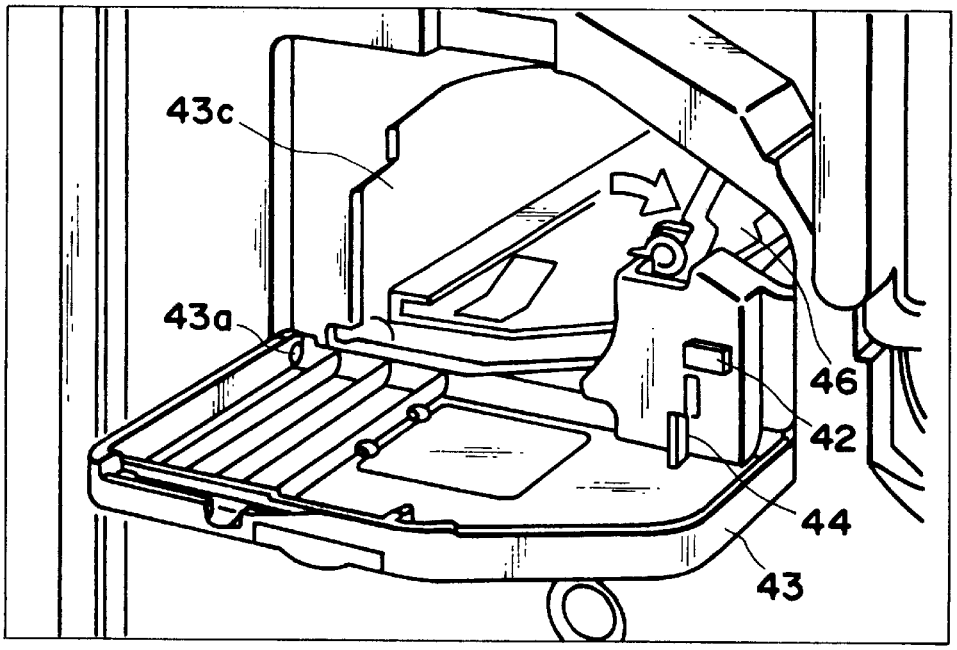
FIG. 5 is a perspective drawing which depicts the method for installing a development unit into the main assembly.

At this time, a method for installing the development units in this embodiment into the printer main assembly will be described with reference to FIGS. 2 through 11. First, a front door, as the lid of the apparatus main assembly 18, is opened by a user, by pivoting it about a vertical hinge 39*a*. In the space behind the front door, a door 43 as a development unit cover is disposed, the bottom edge of which is attached to the apparatus main assembly 18 with the use of a hinge 43*a* (FIG. 4). The color component development units are installed by opening this development unit cover 43. It should be noted that as the front door 39 is opened, the operation of the printer is automatically stopped; a projection 40 attached to the front door 39 releases an interlock switch 41 illustrated in FIG. 13, and as a result, the power circuit of the apparatus main assembly 18, which is run on 24 V, is interrupted.

Figure 13:
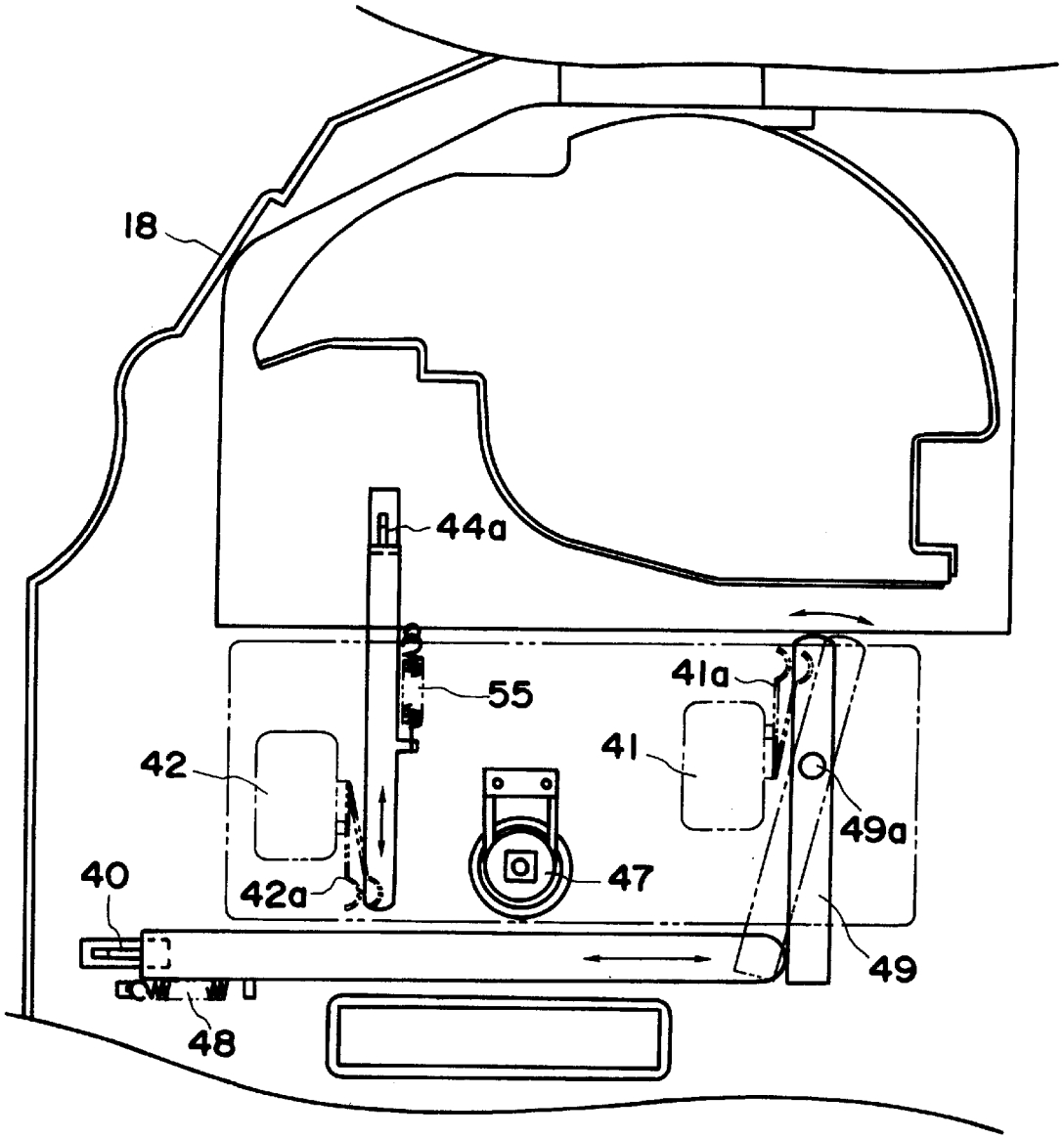
FIG. 13 is a side view of an interlocking switch.

Referring to FIG. 13, the projection 40 is attached to the apparatus main assembly 18, and is horizontally movable. It is also under the pressure applied in the horizontal direction by a tension spring 48. The right-hand end of the projection 40 is placed in contact with one end of a lever 49 pivotally attached to the apparatus main assembly with a pin 49*a*. The other end of the lever 49 is pressing an actuator spring 41*a* of the interlock switch 41 fixed to the apparatus main assembly 18, being therefore under the pressure from the actuator spring 41*a*.

As the operator closes the front door 39 against the force of the spring 48, the projection 40 is pushed by the front door 39, and therefore, it moves rightward, pushing in turn the lever 49. As a result, the lever 49 is pivoted counterclockwise about the pin 49*a*, and pushes the actuator spring 41*a*, turning on the interlock switch 41. As a result, the apparatus main assembly begins to receive power. On the contrary, as the operator opens the front door 39, the projection 40 is moved leftward by the force of the spring 48, allowing the lever 49, which is under the pressure from the actuator spring 41*a*, to pivot clockwise about the pin 49*a* to a position outlined by a double dot-chain line in FIG. 13. As a result, the interlock switch 41 is turned of, and therefore, the apparatus main assembly 18 is cut off from the power source.

The development unit cover 43 is provided with a transparent window 43*b*, so that the operator can confirm the identity of the development unit. When a desired development unit is at a position where it can be removed through an opening 43*c*, a button 47 located below the development unit cover 43 is to be pushed by the operator as shown in FIG. 3 so that the development rotary 23 is rotated to move the desired unit to the position where the desired unit can be removed.

After waiting until the development rotary 23 stops to place the desired development unit at the position where the desired unit can be replaced, the operator opens the development unit cover 43 to expose the section of the development rotary in which the development unit is fitted, as shown in FIG. 4. Then, the operator pushes down a release lever 46 in the direction indicated by an arrow mark in FIG. 5. The release lever 46 is a member that prevents the development unit from moving in the direction in which the development unit is moved out of the development rotary. It is pivotally attached to the development rotary 23, and prevents the frontward movement of the development unit by being placed in contact with the rear portion of the development unit frame. It should be noted here that as the development unit cover 43 is opened to replace a development unit, the development rotary 23 is automatically locked; a projection 44 attached to the development unit cover 43 releases an interlock switch 42 illustrated in FIG. 13, whereby the development rotary stopper solenoid (unillustrated) is activated.

Also referring to FIG. 13, a rod 44*a* that moves by being pushed by the projection 44 is attached to the main assembly 18 in such a manner that it is allowed to move vertically, and is under the upward pressure from a tension coil spring 55. When the rod 44*a* is at the topmost position, it is not pressing the actuator 42*a* of the interlock switch 42, whereas when it is at the bottom most position, it is pressing the actuator 42*a* of the interlock switch 42.

As the operator closes the development unit cover 43 against the force of the spring 55, the projection 44 pushes down the rod 44*a*, and the interlock switch 42 is turned off. Next, as the development unit cover 43 is opened, the projection 44 is moved away from the rod 44*a*, allowing the rod 44*a* to be moved upward by the force of the spring 55, and as a result, the interlock switch 42 is turned on. The interlock switch 42 is wired to the aforementioned solenoid.

Figure 19:
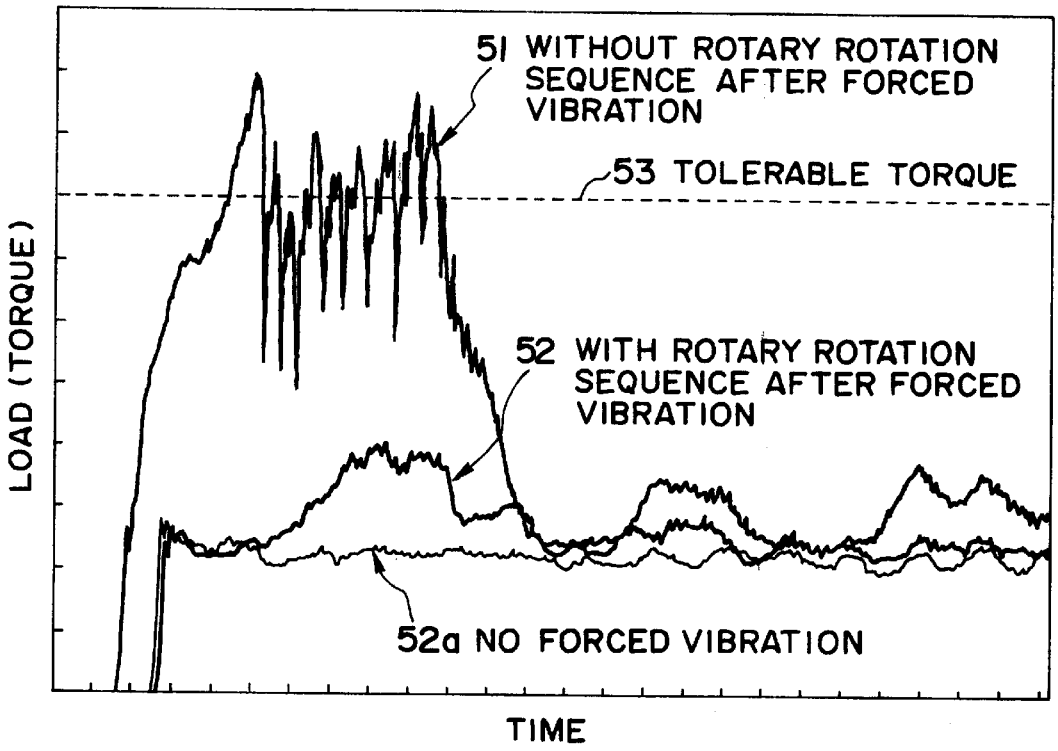
FIG. 19 is a graph of the torque that is needed to drive a development unit.

For example, assuming that the density of the toner in the development unit 20Y (development unit 20M or development unit 20C) has become extremely high due to the vibration that has occurred during the transportation of the development unit 20Y, then, if the development unit in this state is installed, as is, in the main assembly 18, the initial torque necessary for driving the development unit becomes rather high as indicated by a line 51 in FIG. 19. If this initial torque necessary to drive the development unit exceeds the maximum allowable torque 53 of the motor of the apparatus main assembly 18, the development roller and/or the toner conveying member may not be rotated smoothly at the beginning of their rotations, although the rotation of the development roller and/or the toner conveying member eventually reaches its predetermined velocity as the toner density is reduced by its initial rotation.

Figure 6:
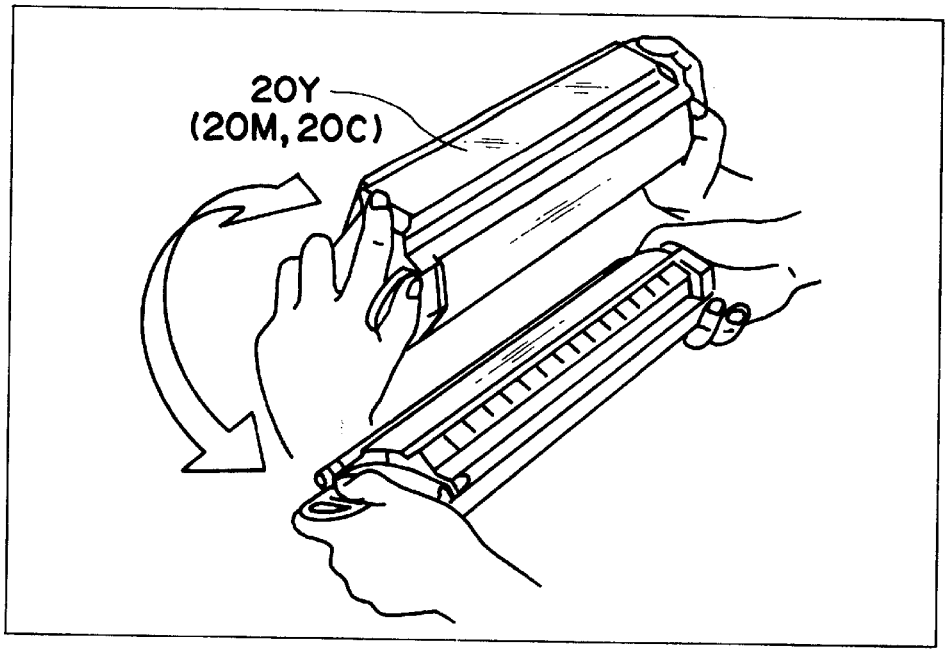
FIG. 6 is a perspective drawing which depicts the method for installing a development unit into the main assembly.
Figure 7:
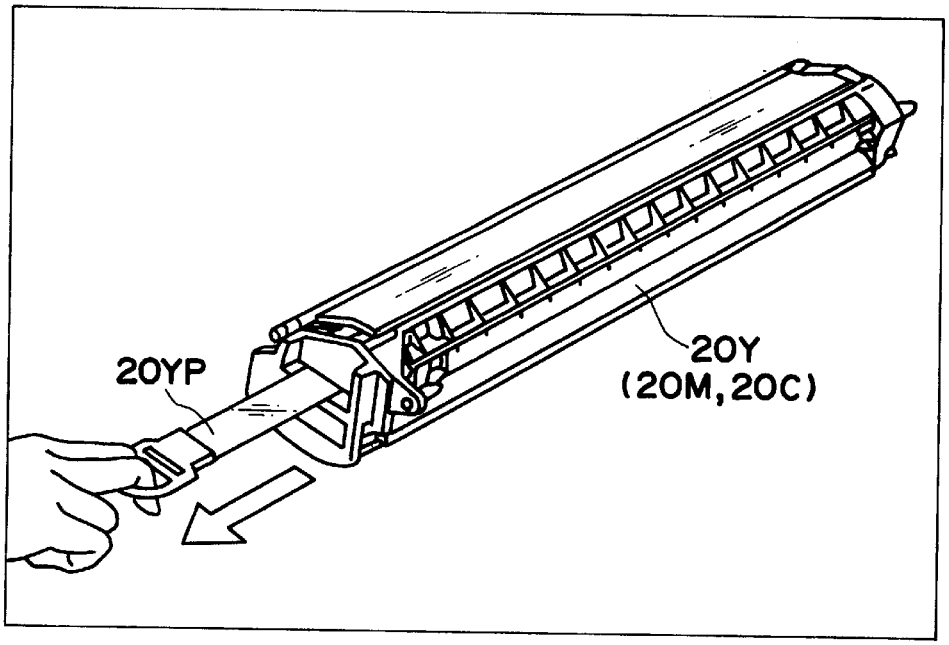
FIG. 7 is a perspective drawing which depicts the method for installing a development unit into the main assembly.

Thus, in order to prevent the above-described problem, the operator must shake the development unit well, as shown in FIG. 6, before installing the color development unit 20Y (color development unit 20M or color development unit 20C) into the apparatus main assembly 18. Next, the toner seal 20YP of the development unit 20Y is peeled in the arrow direction in FIG. 7. The shaking of the development unit 20Y and the peeling of the toner seal 20YP make the toner in the development unit 20Y ready to be supplied to the development roller 20YS. When the toner seal is peeled, the development unit 20Y must be in such a position that the development roller 20YS is on the top side.

Figure 8:
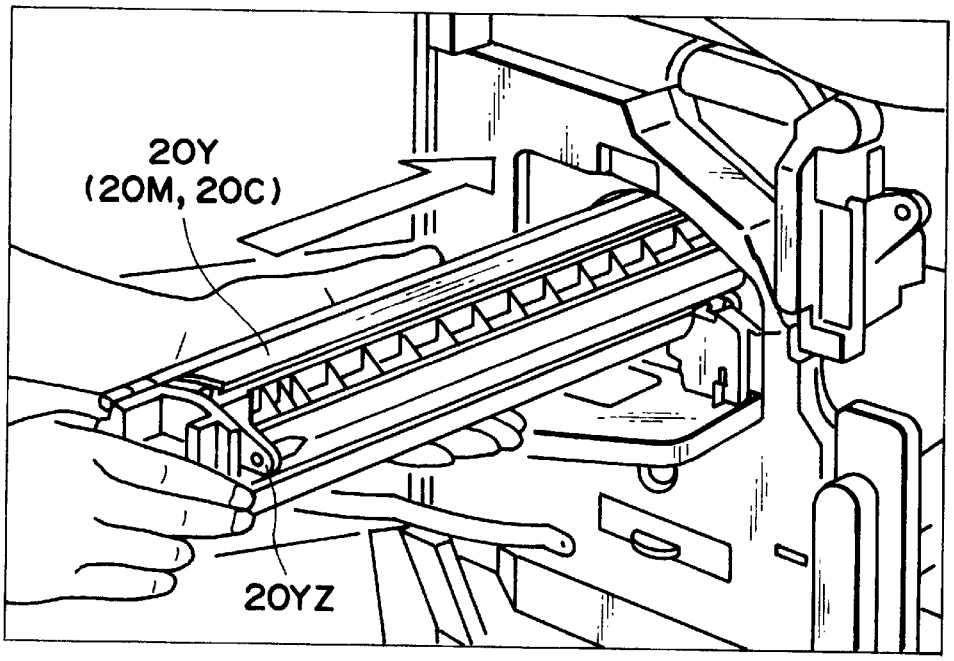
FIG. 8 is a perspective drawing which depicts the method for installing a development unit into the main assembly.
Figure 9:
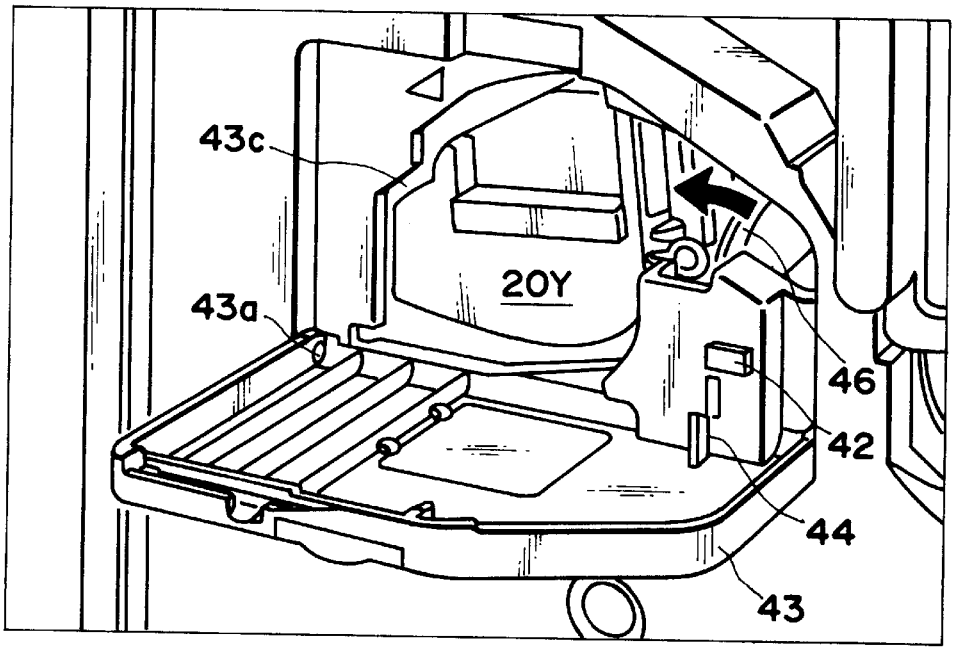
FIG. 9 is a perspective drawing which depicts the method for installing a development unit into the main assembly.
Figure 10:
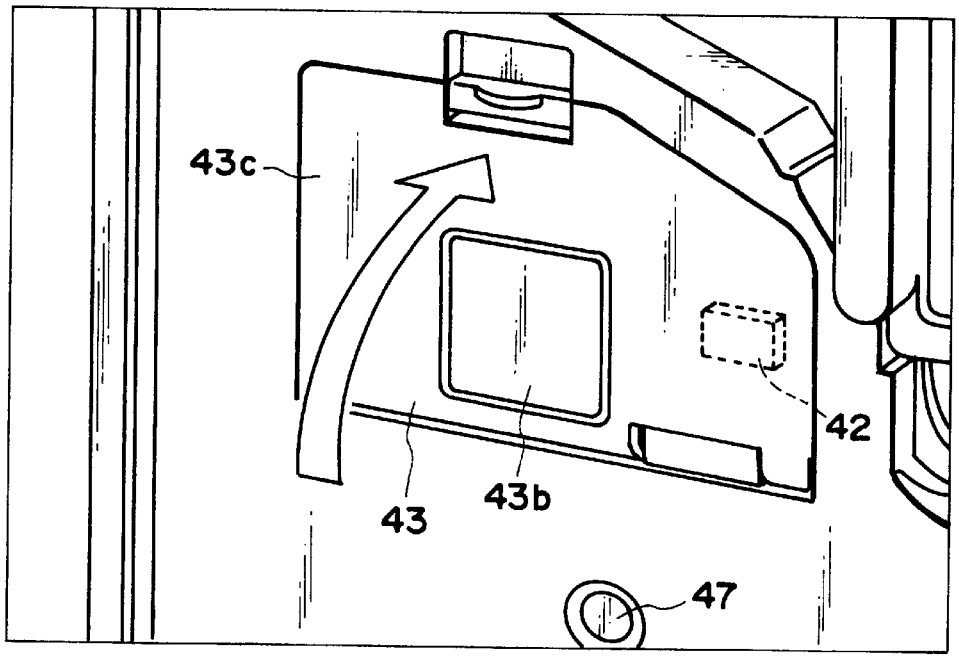
FIG. 10 is a perspective drawing which depicts the method for installing a development unit into the main assembly.
Figure 11:
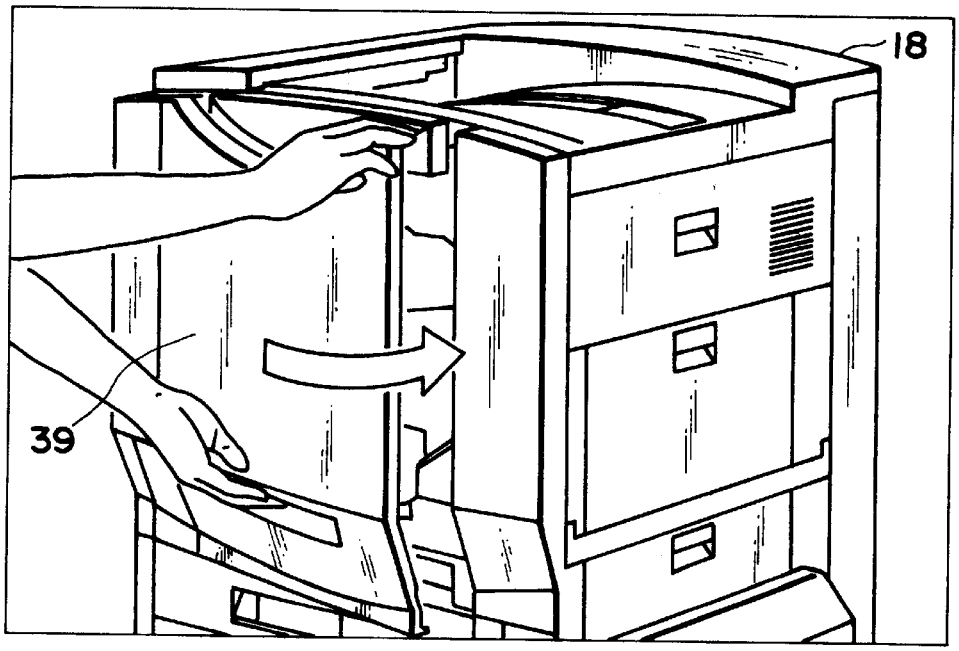
FIG. 11 is a perspective drawing which depicts the method for installing a development unit into the main assembly.
Figure 14:
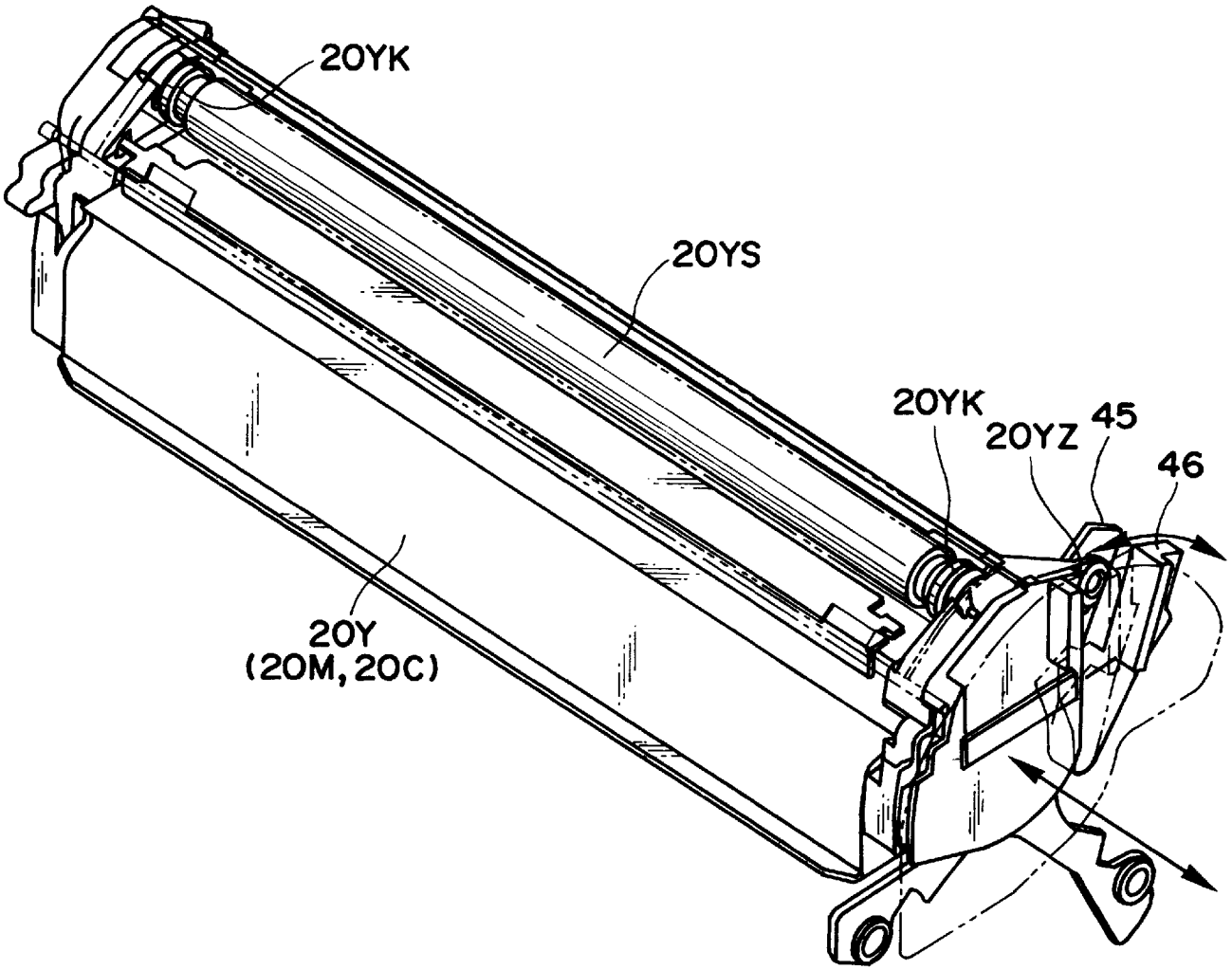
FIG. 14 is a perspective drawing which depicts a method for positioning a development unit into a development rotary.

The color development unit (20Y, 20M or 20C) is inserted in the arrow direction in FIG. 8. It must be inserted by holding it in such a position that the development roller 20YS comes to the top side as shown in FIG. 14. The insertion of the development unit 20Y is completed as the projection 20YZ formed as a portion of the front wall of the housing of the development roller 20YS comes in contact with the flange 45 of the development rotary 23. Next, the operator returns the lever 46 in the arrow direction in FIG. 9 to prevent the development unit 20Y from accidentally coming out frontward, and closes the development unit cover 43, finishing the installation of the development unit. This installation procedure is repeated three times to install all three development units 20Y, 20M and 20C, in the development unit spaces 23A of the development rotary 23.

Figure 15A:
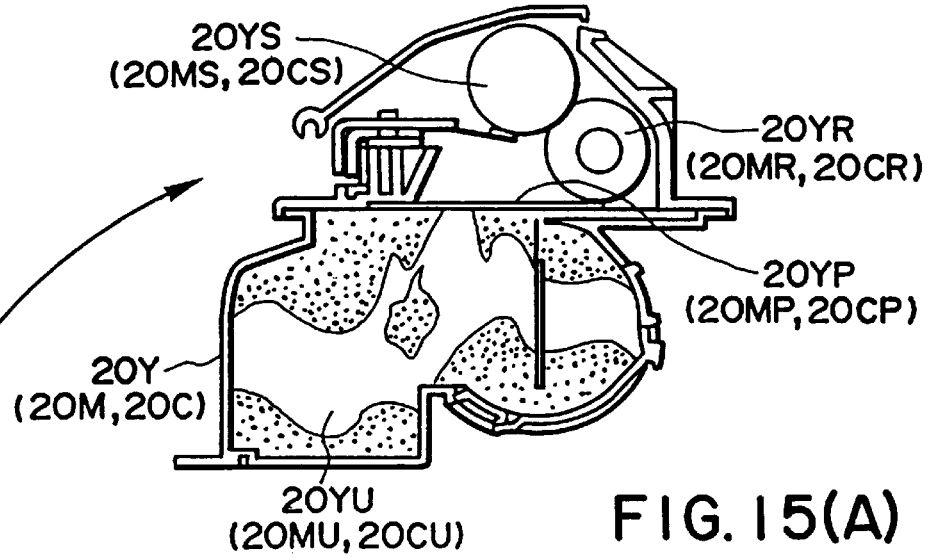
FIG. 15(A) is a sectional drawing which depicts the position of a development unit in a shipment package.

In a factory where the development unit 20Y is manufactured, the development unit 20Y is packaged for shipment, in such a position that the development roller 20YS is on the bottom side as shown in FIG. 15. If the development unit 20Y in this position is vibrated during its shipment or the like situation, the toner in the development unit 20Y is packed adjacent to the toner seal 20YP above the development roller 20YS; the density of the toner increases.

However, in this embodiment, the position in which the development unit 20Y is placed to pull off the toner seal 20YP and install the development unit 20Y into the apparatus main assembly 18 is reversal, in terms of vertical direction, to the position in which the development unit 20Y is placed for shipment; the two positions are different by 180 degrees in the vertical direction. With the development unit 20Y being in the position in which the development roller 20YS is on the top side, the impacted toner in the toner chamber 20YU is likely to naturally loosen, and therefore, even if the operator forgets to shake the development unit 20Y, or does not shake it well, the initial torque necessary for driving the development unit 20Y is prevented from significantly increasing.

To give a supplementary description regarding the properties of the toner in this embodiment, the toner used in this embodiment has the following properties. If a certain amount of the toner used in this embodiment is placed in a bottle, and is vibrated, the density of the toner in the bottom becomes extremely high. Then, if this bottle is held upside down for a certain length of time, the toner in the bottle loosens in only three to ten seconds. In other words, the toner used in this embodiment is such toner that easily packs itself, but also easily loosens itself.

This embodiment is based on this property of the toner. Therefore, the development rotary and the development units are so structured that when the operator installs a new development unit, the development unit is kept, for a predetermined length of time, in such a position that the development roller is on the top side. However, such a structural arrangement does not guarantee that the packed toner in the development unit loosens itself by 100%. Thus, in this embodiment, the development rotary is rotated in accordance with the following sequence.

(Sequence for Rotating Development Rotary)

Figure 18:
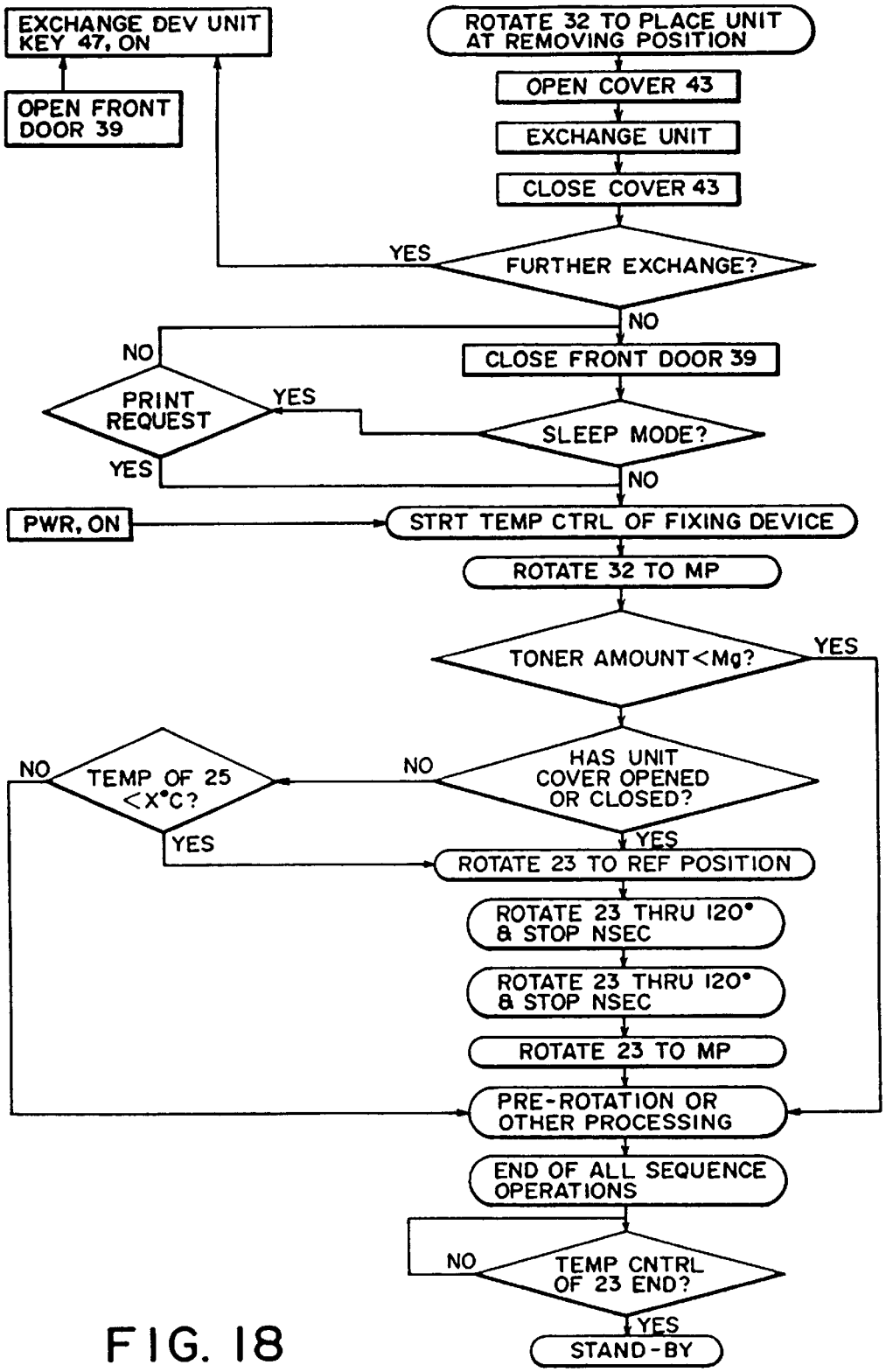
FIG. 18 is a flowchart for the rotational sequence of the development rotary in the first embodiment of the present invention.

Referring to FIGS. 16 and 18, the sequence for rotating the development rotary will be described. The development rotary is rotated following a sequence: A-B-D-E-F.

FIG. 16(A) depicts the development unit 20Y and the development rotary 23 in a state in which the development unit 20Y has been completely installed in the development rotary 23. When the printer is not in a sleep mode (standby mode in which the printer is not used for a predetermined length of time or longer). Temperature control for the thermal fixing device 25 is started.

FIG. 16(B) depicts the development unit 20Y and the development rotary 23 in a state in which the development rotary 23 has begun to be rotated to detect the home position of the development unit 20Y to confirm the position of the development unit 20Y having been installed in the development rotary 23. More specifically, the development rotary 23 is continuously rotated more than once in the clockwise direction indicated by an arrow mark in the drawing, and is stopped at the home position (position at which the development unit 20Y is stopped before it is moved to the image developing position). At the home position, the identity (color) of the development unit 20Y is checked; more specifically, the color label attached to the side wall of the development unit 20Y is detected by a sensor (unillustrated).

Next, the amount of the toner in the development unit 20Y is detected. When the detected amount of the toner is smaller than a predetermined amount (Mg), the initial torque necessary for driving the development unit 20Y is small, and therefore, the following sequence is not carried out. There are two possible cases in which the detected amount of the toner is less than the predetermined amount: a case in which, for some reason, a development unit 20Y, half or more of the toner in which has been used, is installed; and another case in which a development unit 20Y, which had not been fully filled with the toner to begin with.

The first case can be detected by detecting the amount of the toner in the development unit 20Y in advance. This can be detected by a method in which the electrostatic capacity of the toner is detected immediately after the development unit is installed in the development rotary 23, a method in which the density of the toner in the development unit 20Y is detected with a piezoelectric element, or the like method. The second case can be detected by a method in which a member that reflects the amount of the toner initially filled in the development unit 20Y is attached to the side wall of the development unit 20Y, and this member is detected by a sensor (unillustrated) of the apparatus main assembly 18.

However, this step of detecting the amount of the remaining toner in the development unit 20Y may be eliminated. When this step is eliminated, the following sequence is carried out regardless of the amount of the toner in the development unit 20Y. In other words, the system for detecting the amount of the toner in the development unit 20Y to determine whether or not the following sequence should be carried out can be eliminated by eliminating the step for detecting the amount of the toner in the development unit 20Y. In this embodiment, however, a toner amount detecting system to determine whether or not the amount of the toner in the development unit 20Y is above the minimum amount necessary for forming a desirable image is provided. Next, the temperature of the thermal fixing device 25 is detected. When the detected temperature of the thermal fixing device 25 is lower than a predetermined value, the following sequence is carried out, but when the detected temperature of the thermal fixing device 25 is above the predetermined value, the following sequence is not carried out. The temperature of the thermal fixing device 25 is detected by a thermistor (unillustrated) placed in contact with the fixing roller 26.

FIG. 16(C) depicts the development rotary 23 and the development unit 20Y in a state in which the development rotary 23 has been rotated to a referential stop position, that is, the position from which the intermittent development rotary rotation sequence in this embodiment is started, and is being kept there for a predetermined length of time. At this referential stop position, the development unit 20Y is in the position in which the development roller 20YS is on the top side as depicted in FIG. 16(A). In other words, the development unit 20Y is at the position where the development unit 20Y can be removed from the development rotary 23.

FIG. 16(D) depicts the development rotary 23 and the development unit 20Y in a state in which the development rotary 23 has been rotated 120 degrees more, and then, is being kept there for a predetermined length of time.

FIG. 16(E) depicts the development rotary 23 and the development unit 20Y in a state in which the development rotary 23 has been 120 degrees more, and then, is being kept there for a predetermined length of time.

FIG. 16(F) depicts the development rotary 23 and the development unit 20Y in a state in which the development rotary 23 is being rotated to the home position, that is, the position at which the development unit 20Y is stopped before being moved to the image developing position. After the sequence described above through which the development rotary 23 is rotated more than once, the driving force is transmitted to the development roller 20YS from the apparatus main assembly 18.

The sequence described above is carried out according to the flowchart given in FIG. 18.

Figure 15B:
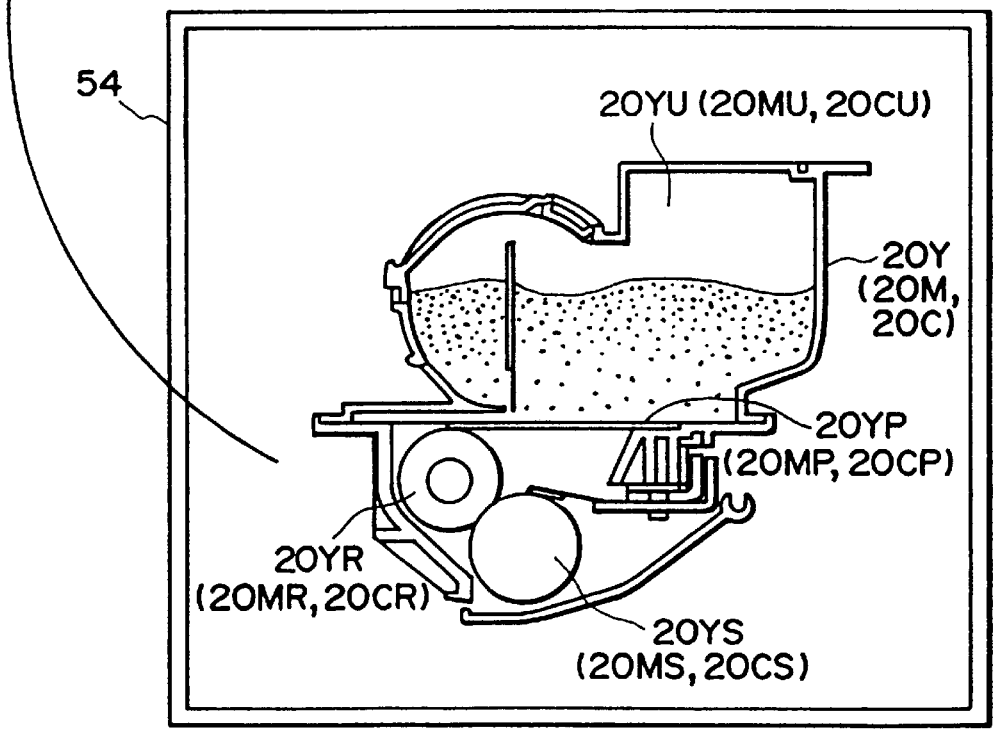
FIG. 15(B) depicts the same development unit after it has been installed in the main assembly of a printer.

It was shown that in this embodiment, as long as the length of time during which development rotary 23 was kept at the referential stop position was set to six seconds or more, the toner in the development unit 20Y sufficiently loosened as depicted in FIG. 15(B).

The torque necessary for driving the development unit 20Y after the development rotary 23 was rotated following the above-described sequence is as represented by a curved line 52 in FIG. 19. As is evident from the graph, the initial torque necessary for driving the development unit 20Y after the development rotary 23 was rotated following the above-described sequence never exceeds the maximum allowable torque output 53 of the motor.

The curved line 52 represents the torque necessary to drive the development unit 20Y after the development unit 20Y sealed with the toner seal 20YP was manually and vigorously shaken by the operator while being held by the operator in such a position that the development roller 20YS was on the bottom side as illustrated in FIG. 15(B); the toner seal 20YP was removed; the unsealed development unit 20Y was installed in the development rotary 23; and the above-described intermittent development rotary rotation sequence was carried out. As is evident from the curved line 52, the initial torque necessary to drive the development unit 20Y was not significantly higher, compared to when the development roller 20YS was on the top side. When the development unit 20Y left in such a position that the development roller 20YS was on the bottom side as illustrated in FIG. 15(B) was installed in the development rotary 23 without being manually shaken by the operator, that is, without being subjected to strong vibration, the torque necessary for driving the development unit 20Y was as represented by the curved line 52*a*. In the test represented by the curved line 52*a*, the above-described intermittent rotation sequence was not carried out, but the initial torque necessary for driving the development unit 20Y was relatively small.

When the development unit 20Y manually shaken by the operator while being held by the operator in such a manner that the development roller 20YS was on the bottom side was installed in the development rotary 23, but the intermittent rotation sequence was not carried out, the initial torque necessary for driving the development unit 20Y exceeded the maximum allowable torque 53 of the motor, as the curved line 52 shows.

Embodiment 2

Next, referring to FIG. 17, the second embodiment of the present invention will be described. In the drawings, the components identical to those described in the first embodiment are designated with the same codes to avoid the repetition of the same descriptions.

In the first embodiment, when the development roller 20YS passes by the photosensitive drum 15 as the development rotary 23 is rotated, the spacer rings 20YK fitted around the longitudinal ends of the development roller 20YS, one for one, come in contact with the peripheral surface of the photosensitive drum 15. Therefore, it is possible that if the impact of the contact between the spacer ring 20YK and the photosensitive drum 15 is large, the layer of the toner coated on the peripheral surface of the development roller 20YS may be partially disturbed.

This second embodiment is different from the first embodiment in the location of the referential stop position. The referential stop position in this embodiment is the position illustrated in FIG. 17(C) where the distance between the peripheral surface of the development roller 20YS and the peripheral surface of the photosensitive drum 15 is smallest, that is, where a latent image on the photosensitive drum 15 is developed. In order to stop the development rotary 23 at the referential stop position, the rotational velocity of the development rotary 23 is reduced before it is stopped at the referential stop position. Therefore, the impact that occurs as the spacer rings 20YK of the development roller 20YS come in contact with the peripheral surface of the photosensitive drum 15 is also reduced. Consequently, the layer of the toner coated on the peripheral surface of the development roller 20YS is prevented from being disturbed, as described above. However, the attitude of the development unit 20Y at the referential stop position is not such that the development roller 20YS is exactly on the top side, and therefore, the development unit 20Y must be kept stationary for a longer time than in the first embodiment; in other words, the development rotary 23 must be kept stationary a longer time than in the first embodiment. In this embodiment, the eight seconds or more was necessary. As is evident from the description given above, in this embodiment, the development rotary 23 having been stopped at the home position is rotated to the referential stop position, and is stopped there for approximately eight seconds. Then, the development rotary 23 is rotated approximately 120 degrees, and is stopped for approximately eight seconds. Thereafter, the development rotary 23 is rotated again approximately 120 degrees, and is stopped for approximately eight seconds. Then, the development rotary 23 is rotated again approximately 120 degrees, and is stopped for approximately eight seconds. This rotational sequence is carried out to loosen the toner in the development unit.

In the preceding embodiments, the present invention was described with reference to an electrophotographic color image forming apparatus. But, it is needless to say that the same effects as those described above are obtained when the present invention is applied to a monochromatic image forming apparatus.

Further, in the preceding embodiments, the direction in which the development unit is inserted into the development rotary was the same as the direction of the generation of the photosensitive drum. But, obviously, the same effects as those described above can be also obtained when the present invention is applied to an image forming apparatus, in which the development unit is inserted into the development rotary in the direction perpendicular to the generatrix of the photosensitive drum.

Further, in the preceding embodiments, the present invention was described with reference to the development unit 20Y for yellow color component. But, apparently, the description given above with reference to the development unit 20Y also applies to other development units 20M and 20C.

Further, the same effects as those described with reference to the development unit for yellow color component in the preceding embodiments can be obtained even if the development unit for black color component is installed in the development rotary.

The development unit to which the present invention is applicable includes the black component development unit, as well as the color component development units. In order for a development unit to be compatible with the present invention, a development unit has only to comprise a toner storing portion and an image developing member (for example, development roller); the development unit may comprise any one, or all, of an electrophotographic photosensitive member, a charging member, and a cleaning member, in addition to a toner storing portion and an image developing member. The development unit means a unit that integrally comprises these components, and is removably installable in the development rotary of the main assembly of an image forming apparatus.

In other words, structures to which the present invention is applicable are not limited to the structure described in the preceding embodiments. For example, the present invention is applicable to such an image forming apparatus structure in which a single color component development unit, or a single black component development unit, is removably installable as a development rotary.

Figure 20:
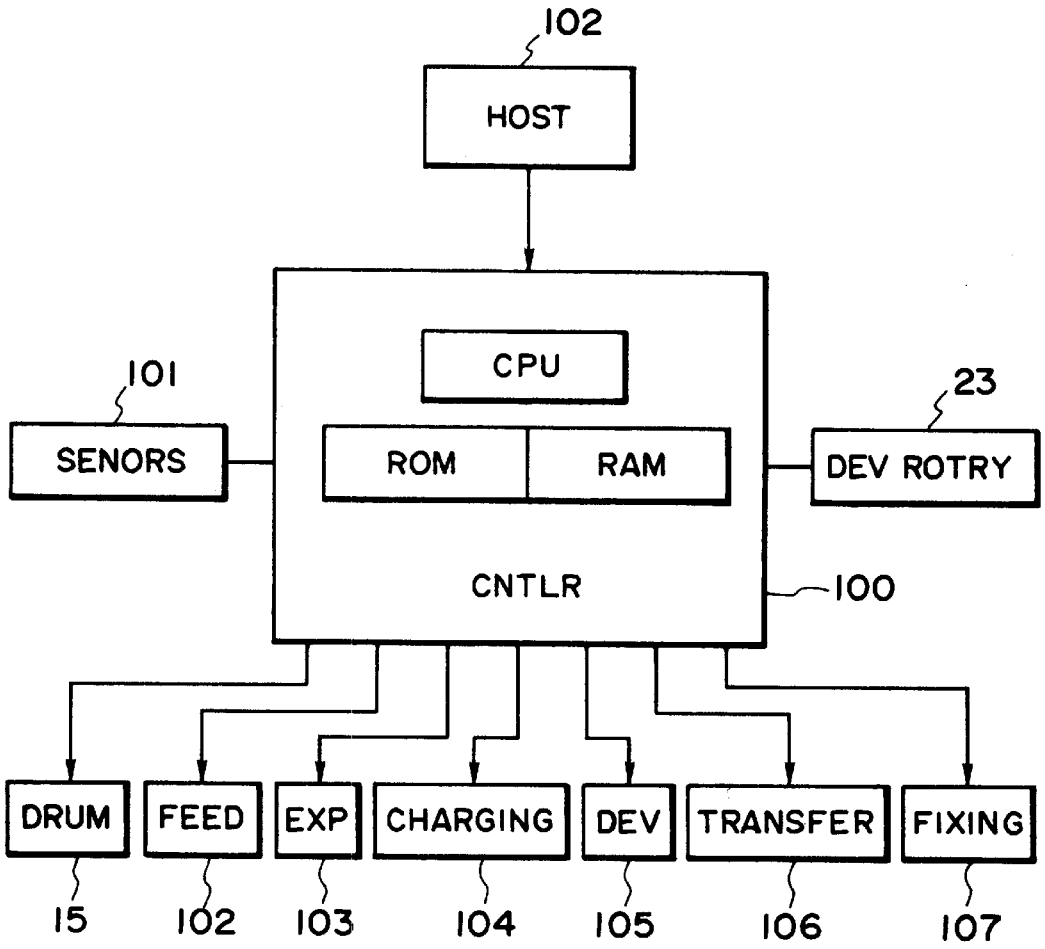
FIG. 20 is a block diagram of the printing system in the first embodiment of the present invention.

Next, referring to FIG. 20 which is a block diagram, the general operational sequence of the structures in the preceding embodiments will be described.

In the diagram, a referential figure 100 designates a control section that controls the entirety of the apparatus. The control section 100 comprises: a CPU such as a microprocessor; ROM's which store the control programs for the CPU, such as the one depicted by the flow-chart in FIG. 18; RAM's which are used as the work areas for the CPU, and temporarily store various data; and the like components.

The control section 100 receives electrical signals from a group 101 of sensors; the interlock switch 41 for detecting the opening or closing of the front door 39 (FIG. 2); the interlock switch 42 for detecting the opening or closing of the development unit cover 43 (FIG. 3); a sensor S3 for detecting the temperature of the thermal fixing device 25 (FIG. 1); a sensor (jam sensor) for detecting the recording medium jam that occurs during recording medium conveyance (unillustrated); and the like sensors. The control section 100 also receives image data or the like from a host 102 such as a computer or a word processor. Based on these electrical signals and image data, and the like, the control section 100 controls, as described before, the rotation of the photosensitive drum 15, and various image forming processes: conveying 102 of the recording medium 2; exposing 103; charging 104; developing 105; transferring; and fixing 107, as well as the rotation of the development rotary 23.

The following is the summary of the preceding embodiments. An image forming apparatus for forming an image on recording medium comprises: an image bearing member (for example, the electrophotographic photosensitive drum 15); a rotatable development rotary (23); development unit installation spaces (23A) in which development units (for example, color component development units 20Y, 20M and 20C) for developing latent images formed on the image bearing member are removably installed; and a control section (100) which carries out an intermittent development rotary rotation sequence, in which the development rotary (23) is temporarily stopped after it is rotated by a predetermined angle, is repeated a predetermined number of times immediately after the development unit is replaced.

Before carrying out the intermittent development rotary rotation sequence, the control section carries out a sequence in which the development rotary (23) is rotated until it reaches the referential stop position.

The aforementioned referential stop position is a position at which the distance between the development roller of a development unit and a photosensitive drum (15) as the image bearing member becomes smallest.

When the temperature of a thermal fixing device (25) is lower than a predetermined temperature, the control section (100) carries out the intermittent rotation sequence, whereas when the temperature of the thermal fixing device (25) is higher than the predetermined temperature, the intermittent rotation sequence is not carried out. The thermal fixing device (25) is a device for thermally fixing the toner image having been transferred onto a recording medium (2), to the recording medium (2).

After a development unit desired to be replaced is replaced, the control unit first rotates the development rotary (23) to the referential stop position, and then, carries out the intermittent development rotary rotation sequence.

The control section recognizes the completion of the development replacement process by sensing that a cover (for example, the development unit cover 43) for covering the opening (43) through which the development unit in the development unit space (23A) is replaced is opened, and closed, and then, the front door is closed. After recognizing the completion of the development unit replacement process, the control section carries out the non intermittent development rotary rotation sequence.

A development unit is replaced in the following manner; first, the front cover is opened; next, the cover (43) which covers the opening through which a development unit in the development installation space (23A) is replaced is opened; and then, the desired development unit is replaced. The control section (100) recognizes that all of the desired development units have been replaced by detecting the closing of the front door (39) Then, the control section (100) carries out the nonintermittent development rotary rotation sequence, in which the predetermined point of the development rotary (23) is rotated to the referential point. Thereafter, the control section (23) carries out the intermittent development rotary rotation sequence.

Further, the main assembly of an image forming apparatus is provided with a button (47). As the button (47) is pressed, the development rotary (23) is rotated by a predetermined angle, so that the one of the plurality of the development units installed in the development rotary (23) is moved to the position where the development unit can be removed through the opening (43*c*).

The effects of the preceding embodiments are as follows:

(1) Even when an operator installs a development unit into the main assembly of an image forming apparatus without sufficiently shaking the development unit, the initial torque necessary to drive the development unit can be prevented from becoming significantly high. Therefore, the driving system is not subjected to a sudden increase of the torque, and as a result, image formation is stably carried out.

In addition, it is unnecessary to switch the currently used development unit motor, or the driver, to larger ones, and therefore, it is possible to prevent the size of the main assembly, and the cost of the apparatus, from increasing.

(2) When the temperature of the thermal fixing device is higher than a predetermined temperature, the intermittent development rotary rotation sequence is not carried out. For example, immediately after an operator turns off, by mistake, the power switch of the apparatus main assembly, or unplugs the main assembly from the power source, during the malfunctioning, such as a paper jam, the thermal fixing apparatus is sufficiently high, and therefore, the intermittent development rotary rotation sequence is not carried out. As a result, the standby state can be reached in a shorter time.

On the other hand, it is possible that an operator replaces the development unit after the operator has turned off the power switch, or unplugs the apparatus from the power source, by mistake. This is a rather unusual case. However, even in such a case, the intermittent development rotary rotation sequence is carried out if the temperature of the thermal fixing device is lower than the predetermined one, and therefore, the initial torque necessary for driving a development unit can be prevented from significantly increasing.

(3) When the amount of the toner in a development unit is smaller than a predetermined amount, the intermittent development rotary rotation sequence is not carried out. Therefore, an image forming apparatus can reach the standby state in a shorter time.

(4) The position at which a development unit is stopped is the image developing position, and the revolution of the motor which drives a development rotary can be sufficiently reduced before the development unit is stopped at the image developing position. Therefore, the impact that occurs when a development roller and an electrophotographic photosensitive drum come in contact with each other can be reduced. Consequently, the layer of toner coated on the development roller is not disturbed. As a result, an image forming apparatus is prevented from forming abnormal images at the beginning of an image forming operation.

As described above, according to the present invention, the aggregated toner in a development unit can be loosened by the intermittent development rotary rotation.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a plurality of developing units for developing electrostatic latent images formed on said image bearing member with different color toners;

a rotatable rotary member for supporting said plurality of developing units;

heat fixing means for fixing a toner image on a recording material after the toner image is transferred onto the recording material from said image bearing member; and control means for effecting intermittent rotation of said rotary member so as to change an orientation of said developing units before said image forming apparatus is placed in a stand-by state, when it is detected that a temperature of said fixing means is lower than a predetermined level.

2. An apparatus according to claim 1, further comprising an opening for permitting mounting and demounting of said developing units relative to said rotary member, and a unit cover for closing said opening, wherein said control means effects the intermittent rotation before the apparatus is brought into the stand-by state after an operation of closing said unit cover is detected.

3. An apparatus according to claim 2, wherein said control means effects the intermittent rotation after detection of the operation of closing said unit cover and before said image forming apparatus is placed in the stand-by state, irrespective of detected temperature.

4. An apparatus according to claim 2, wherein when the operation of closing said unit cover is not detected, and it is detected that the temperature is higher than the predetermined temperature, said control means does not effect the intermittent rotation before the image forming apparatus is placed in the standby state.

5. An apparatus according to claim 1, wherein said rotary member is stopped at a reference position after at least one of said developing units is exchanged with a fresh developing unit.

6. An apparatus according to claim 5, wherein said intermittent rotation is started after the rotary member is stopped at the reference position.

7. An apparatus according to claim 1, wherein the intermittent rotation is prevented when an amount of the toner in one of the developing units is detected as being lower than a predetermined level.

8. An apparatus according to claim 1, wherein when it is detected that the temperature is higher than the predetermined level, said control means does not effect the intermittent rotation before said image forming apparatus is placed in the stand-by state.

9. A multi-color image forming apparatus for forming a multi-color image on a recording material, comprising:

an image bearing member;

a heating and fixing device for fixing the toner image on the recording material having received the toner image formed on said image bearing member;

a developing unit mounting portion for detachably mounting a plurality of developing units for developing, with different colors, an electrostatic latent images formed on said image bearing member provided on a rotatable developing rotary;

a unit cover for closing an opening for permitting mounting-and-demounting of said developing unit relative to said developing unit mounting portion;

an open/close detecting portion for detecting opening and closing of said unit cover;

a main assembly cover;

an open/close detecting portion for detecting opening and closing of said main assembly cover;

a controller for rotating said developing rotary, after said main assembly cover is closed, through a predetermined degree to a reference stop position, if said unit cover is opened and closed, and a temperature of said heating and fixing device is lower than a predetermined temperature, and for executing an intermittent rotating operation wherein said developing rotary is repeatedly rotated and stopped for a predetermined duration, if a predetermined condition is satisfied after said developing rotary is rotated through the predetermined degree.

10. An apparatus according to claim 9, wherein said reference stop position is a position where a developing roller of said developing unit is opposed to an electrophotographic photosensitive drum.

11. An apparatus according to either claim 9 or 10, wherein when a developing unit on said developing rotary is exchanged, said controller rotates said developing rotary to the reference stop position, and then, said intermittent rotating operation is executed.

12. An apparatus according to claim 11, wherein said controller executes said rotating operation after exchange of a developing unit is detected by an detecting that said unit cover for covering an opening for permitting exchange of a developing unit mounted on said developing unit mounting portion is opened and then closed, and said main assembly cover is closed.

13. An apparatus according to claim 9, wherein the main assembly is provided with a switch for rotating said developing rotary through a predetermined angle, and one of said developing units on said developing rotary is moved to a position where it is demountable from said opening.

14. An apparatus according to claim 9, wherein the plurality of said developing units includes a yellow developing unit having a yellow developing device for developing the electrostatic latent image with yellow toner and a yellow toner accommodating portion for accommodating yellow toner; a cyan developing unit having a cyan developing device for developing the electrostatic latent image with cyan toner and a cyan toner accommodating portion for accommodating cyan toner; and a magenta developing unit having a magenta developing device for developing the electrostatic latent image with magenta toner and a magenta toner accommodating portion accommodating magenta toner.

* * * * *

UNITED STATES PATENT AND TRADEMARK OFFICE

CERTIFICATE OF CORRECTION

PATENT NO. : 6,295,429 B1
DATED : September 25, 2001
INVENTOR(S) : Hironobu Isobe et al.

It is certified that error appears in the above-identified patent and that said Letters Patent is hereby corrected as shown below:

Title page,
Item [57], ABSTRACT, line 2, "are" should read -- and --.

Column 3,
Line 62, "an" should read -- a --.

Column 4,
Line 49, "the" should read -- and the --.

Column7,
Line 67, "are" should read -- is --.

Column 10,
Line 67, "FIG. 15." should read -- FIG. 15(B). --.

Column 11,
Line 29, "this" should read -- the above-mentioned --.

Column 14,
Line 21, "the" should be deleted.

Column 15,
Line 21, "ROM's" should read -- ROMs --;
Line 23, "RAM's" should read -- RAMs --;
Line 32, "occurs" should read -- may occur --;
Line 40, "transferring;" should read -- transferring 106; --; and
Line 54, "is" should read -- that is --.

Column 16,
Line 17, "non intermitten" should read -- non-intermittent --;
Line 30, "section (23)" should read -- section (100) --; and
Line 58, "high," should read -- high in temperature --.

UNITED STATES PATENT AND TRADEMARK OFFICE

CERTIFICATE OF CORRECTION

PATENT NO. : 6,295,429 B1
DATED : September 25, 2001
INVENTOR(S) : Hironobu Isobe et al.

It is certified that error appears in the above-identified patent and that said Letters Patent is hereby corrected as shown below:

Column 17,
Line 63, "standby" should read -- stand-by --.

Column 18,
Line 23, "an" should be deleted;
Line 27, "mounting-and-remounting" should read -- mounting and demounting --; and
Line 57, "an" should be deleted.

Signed and Sealed this

Thirtieth Day of April, 2002

*Attest:*

*Attesting Officer*

JAMES E. ROGAN
*Director of the United States Patent and Trademark Office*